United States Patent [19]

Wormser

[11] 4,300,889

[45] Nov. 17, 1981

[54] SHALLOW DRAFT PROPELLER POCKET

[76] Inventor: Robert S. Wormser, 6880 SW. 19th Ave., Ocala, Fla. 32671

[21] Appl. No.: 136,315

[22] Filed: Apr. 1, 1980

[51] Int. Cl.[3] ..... B63H 5/06

[52] U.S. Cl. ..... 440/69

[58] Field of Search ..... 440/68, 69, 70, 112, 440/41; 114/271, 288, 289, 291, 57

[56] References Cited

U.S. PATENT DOCUMENTS

| | | | |
|---|---|---|---|
| 1,007,583 | 10/1911 | Loetzer | 440/69 |
| 3,469,557 | 9/1969 | Wollard | 440/69 |
| 3,744,446 | 7/1973 | Gibbins | 440/69 |
| 3,823,683 | 7/1974 | Usborne | 440/41 |

*Primary Examiner*—Galen L. Barefoot
*Assistant Examiner*—Jesús D. Sotelo
*Attorney, Agent, or Firm*—Beaman & Beaman

[57] ABSTRACT

The invention pertains to a propeller pocket for reducing the draft of propeller driven marine craft, and the propeller pocket of the invention utilizes an increasing vertical dimension in the direction of the craft stern, the pocket being defined by planar surfaces, and the water within the pocket being "gathered" as the water approaches the stern to minimize cavitation at the propeller. The pocket is advantageous for use with either inboard, inboard/outboard or outboard driven installations and provides increased drive efficiencies with a reduction in hull draft.

6 Claims, 5 Drawing Figures

SHALLOW DRAFT PROPELLER POCKET

BACKGROUND OF THE INVENTION

The desire to reduce the draft of propeller driven marine craft has long existed, and a variety of proposals has been made for reducing the hull draft while accommodating a propeller, examples being shown in U.S. Pat. Nos. 872,389; 1,007,583; 1,059,806; 3,469,549 and 3,744,446. Various concepts are used with such propeller pockets such as tunnels, channeling devices, and varying cross section configurations. While a number of the proposed designs do offer advantages of one aspect or another, many shallow draft tunnels and channels are unacceptable for high speed watercraft in that cavitation problems at the propeller are aggravated, steering is adversely affected, and installation of the propeller shaft and driving gear is difficult.

It is an object of the invention to provide a propeller pocket for relatively high speed watercraft which may be used with either inboard, inboard/outboard, or outboard propeller drives, and wherein propeller cavitation is minimized.

Another object of the invention is to provide a shallow draft pocket for propeller driven watercraft wherein the configuration of the pocket may be incorporated into a wide variety of hull forms, and the installation of inboard driving gear is simplified.

A further object of the invention is to provide a shallow draft pocket for propeller driven marine craft wherein the pocket configuration aids in supplying the propeller with water with a minimum of turbulance wherein cavitation at the propeller is substantially eliminated within normal operating speed ranges.

In the practice of the invention the shallow draft pocket is defined by a plurality of planar surfaces formed in the watercraft hull adjacent the stern. A planar transition surface obliquely oriented upwardly and rearwardly intersects an upward obliquely defined surface which extends toward the hull's stern. The lateral sides of the upper surface are intersected by obliquely disposed side surfaces upwardly converging and intersecting the upper surface to form a uniformly decreasing upper surface width in the direction of the stern. The upper surface engages a deflection surface intersecting the stern which is, preferably, slightly obliquely oriented to the horizontal in a downward direction, and the resultant water flow of these surfaces provides an adequate supply of water, at low turbulence, to the propeller region.

In an inboard powered installation, a propeller shaft recess intersects the pocket upper surface and includes a surface substantially perpendicularly disposed to the propeller axis, and the presence of this recess, plus the presence of a positioning depression located adjacent the upper surface, greatly aids in simplifying the installation of an inboard propeller drive within the pocket of the invention.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 4:
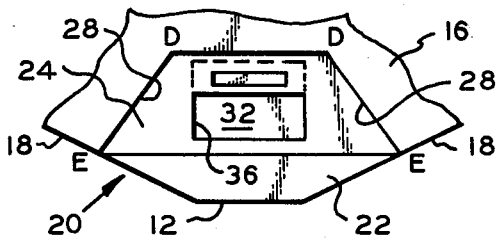
FIG. 4 is a detail, end, elevational view of the pocket of the invention as taken along Section IV—IV of FIG. 3.
Figure 5:
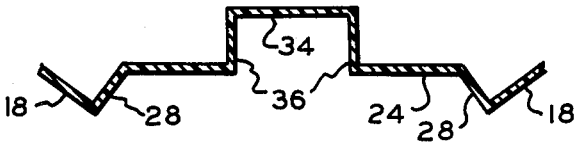
FIG. 5 is an elevational sectional view taken through the pocket along Section V—V of FIG. 3.

The shallow draft propeller pocket of the invention may be employed with a wide variety of marinecraft hull configurations, and in the drawings a typical hull configuration is illustrated utilizing the invention. The hull 10 includes a substantially horizontal keel 12 extending between bow 14 and stern 16, and the hull includes side surfaces 18, FIG. 4, converging in the direction of the keel. While the hull utilizing the pocket of the invention may be formed of any conventional material such as wood, plywood, aluminum, steel, etc., preferably, the hull is constructed of fiberglass utilizing known techniques.

The shallow draft pocket, generally indicated at 20, is located adjacent the stern 16, is symmetrically oriented to the keel 12, and extends in a forward direction. The pocket intersects the stern 16, and it is to be appreciated that the inventive concepts derived from the invention may be utilized with either inboard, inboard/outboard, or outboard propeller drives.

Figure 2:
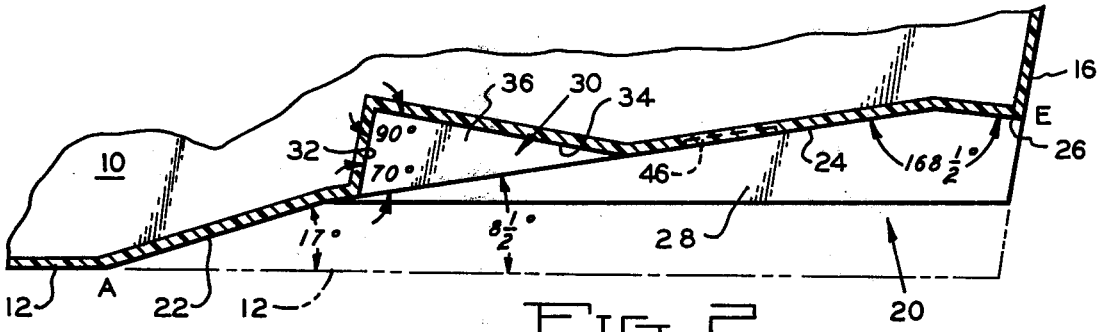
FIG. 2 is an enlarged, detail, elevational, sectional view of the shallow draft pocket in accord with the invention, the propeller and drive shaft structure being eliminated for purpose of illustration.

The keel 12 is substantially flat and horizontally disposed, and is projected in a dotted line in FIG. 2, and is used in the following description for reference purposes. The configuration of the shallow draft pocket 20 in accord with the invention is best appreciated from FIG. 3. In the illustrated embodiment a shaft recess is illustrated for use with an inboard propeller drive, and it is to be understood that the shaft recess will be eliminated if it is predetermined that the hull will be used only with inboard/outboard, or outboard propeller drive units.

The pocket 20 includes a flat transition surface 22 defined by hull intersections A—A and B—B. The surface 22 is obliquely oriented upwardly and rearwardly at approximately 17° to the horizontal, and the line B—B constitutes an entrance edge to the primary portion of the pocket.

The upper panel of the primary portion of the pocket 20 is defined by a planar upwardly inclined upper surface 24 which intersects surface 22 at B—B, and inclines upwardly at approximately $8\frac{1}{2}°$ to the horizontal. The upper surface 24 extends toward the stern 16 until it intersects the flat deflection surface 26 at line C—C, and the deflection surface 26 extends from intersection lines C—C to the stern 16 defining an intersection line D—D therewith. As will be appreciated from FIG. 2, the deflection surface 26 is obliquely disposed in a downwardly direction from intersection C—C to D—D approximately 3° to the horizontal, forming an abtuse angle of $168\frac{1}{2}°$ with surface 24, and this deflection aids in the anticavitation properties of the shallow draft pocket. The surface 26 is of uniform width as lines C-D are parallel.

Figure 3:
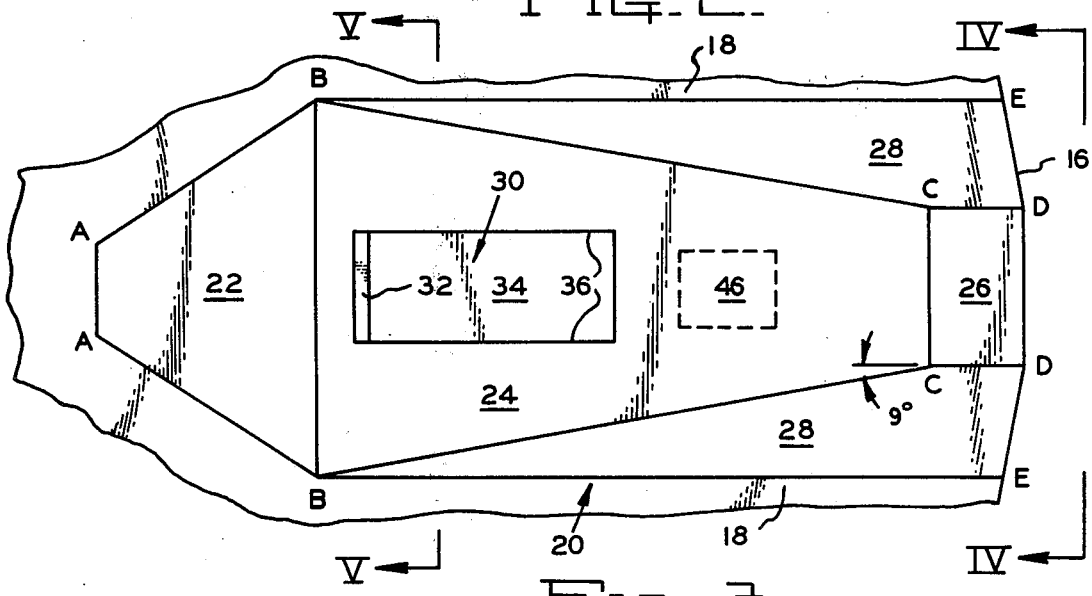
FIG. 3 is a bottom plan view of the pocket as shown in FIG. 2.

The lateral portions of the pocket 20 are defined by flat lateral side surfaces 28, which are of a quadrilateral configuration, FIG. 3. The surfaces 28 extend from the ends of the intersection B—B to the stern at intersections E, and intersections B-C are defined with surface 24 and C-D with surface 26. The oblique orientation of the surfaces 24 and 28 results in a 9° deviation from the projection of the intersection lines C-D with lines B-C, wherein lines C-D extend parallal to the axis of the hull and length of the keel.

The distance B—B is greater by about 3 inches than the distance E—E, and this narrowing of the width of the pocket 20 tends to "gather" or funnel the water as it approaches the dimension E—E at the stern to eliminate cavitation at the propeller, yet this dimension reduction does not affect the steering. Likewise, the 3° deviation of deflection surface 26 downwardly from C—C to D—D aids in the elimination of propeller cavitation without affecting the steering capability of the watercraft.

The water enters the pocket 20 along transition surface 22 and smoothly flows into the main portion of the pocket under surface 24 as the water passes the entrance edge B—B. The oblique angle of the upper surface 24 is such as to permit the water to flow smoothly into the pocket without excessive turbulance, and the configuration of the lateral sides 28 and deflection surface 26 assure a funneling of the water at the desired location.

Figure 1:
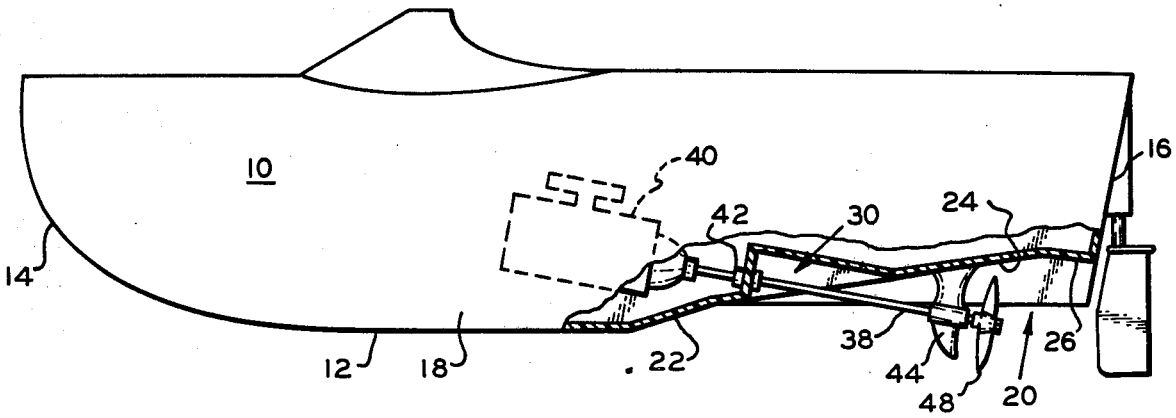
FIG. 1 is a side elevational view of watercraft employing the shallow draft pocket of the invention, partially sectioned.

If the pocket 20 is to be used with a hull having an inboard drive shaft recess 30 is defined in the hull intersecting the upper surface 24 to simplify installation of the inboard drive. The shaft recess consists of an upwardly extending surface 32 defining an angle of approximately 70° with the upper surface, and the upper recess surface 34 intersects the surface 32, at a 90° angle. The lateral sides of the pocket are defined by vertical sides 36, and as will be appreciated from FIG. 2, the surface 34 smoothly intersects the pocket upper surface 24. Thus, as will be apparent from FIG. 1, the propeller shaft 38 driven by engine 40 will pass through the surface 32, and water tight gland 42 in a perpendicular manner. The propeller support strut 44 is mounted within the pocket 20, and a positioning depression 46 may be defined in the surface 24 to aid in the installation of the strut. As will be appreciated from FIG. 1, the propeller 48 is located adjacent the intersection C—C, and as the water has been funneled or "gathered" to this location cavitation at the propeller is reduced.

The width of the pocket at B—B is substantially greater than the width of the shaft recess 30 whereby water may flow smoothly past the shaft recess without significant turbulence, and the presence of the shaft recess does not adversely affect the advantages derived by the shallow draft pocket 20.

With an inboard/outboard installation, or if the watercraft is driven by a conventional outboard, the propeller will be located adjacent the stern 16, below the deflection surface 26, and tests have indicated that the advantages of the pocket 20 described above are present with such outboard drives, as well as an inboard drive arrangement, due to the funneling of the water toward the stern. Tests have indicated that increased fuel efficiencies and greater speeds at a given rpm are achieved with the utilization of the shallow draft pocket of the invention due to reduced cavitation, and as the major portion of the propeller lies above the keel depth watercraft utilizing the invention may successfully operate in water considerably shallower than that otherwise possible.

It is appreciated that various modifications to the inventive concepts may be apparent to those skilled in the art without departing from the spirit and scope of the invention.

I claim:

1. In a propeller driven watercraft having a hull including a bow, a stern, a longitudinal axis and a keel, the improvement comprising an elongated water receiving flow control pocket defined in the hull and intersecting the stern, said pocket including an entrance edge transversely disposed to the hull axis, an upper planar surface extending from said entrance edge obliquely upward toward said stern, said upper surface having lateral edges converging in the direction of said stern, planar lateral surfaces each having a lower edge intersecting said hull and an upper edge intersecting said upper surface defining said upper surface lateral edges, said lateral surfaces each converging upwardly and of a generally triangular configuration each having an apex intersecting said entrance edge and a base intersecting said stern, the transverse dimension of said entrance edge being slightly greater than the transverse dimension between the intersection of said lateral surfaces and said hull at said stern, a planar deflector surface intersecting said upper surface, stern, and said lateral surfaces, said deflector surface being slightly obliquely related to the horizontal extending downwardly from its intersection with said upper surface toward said stern, and a planar transition surface extending obliquely forward and downward of said entrance edge intersecting said entrance edge throughout its length and intersecting said hull and keel, said transition surface having a forward edge having a transverse width less than the transverse width of said pocket entrance edge.

2. In a propeller driven watercraft as in claim 1 wherein said deflector surface is of a substantially uniform width in the direction of the hull axis.

3. In a propellor driven watercraft as in claim 2 wherein said deflector surface is obliquely related to the horizontal by approximately 3°.

4. In a propeller driven watercraft as in claim 1, wherein said transition surface is obliquely related to the horizontal by approximately 17°.

5. In a propeller driven watercraft as in claim 1 wherein said upper surface is obliquely related to the horizontal by approximately 8½°.

6. In a propeller driven watercraft as in claim 1, a propeller shaft receiving recess defined in the hull intersecting said pocket upper surface, said recess including a first surface intersecting said upper surface at an acute angle and second surfaces extending toward the stern, the angle of said first surface being substantially perpendicular to an inboard propeller shaft extending into said pocket through said first surface.

* * * * *